United States Patent [19]

Baker

[11] 4,138,045

[45] Feb. 6, 1979

[54] CAMERA CASE

[75] Inventor: Robert A. Baker, Dandridge, Tenn.

[73] Assignee: Engineered Products, Inc., Dandridge, Tenn.

[21] Appl. No.: 806,867

[22] Filed: Jun. 15, 1977

[51] Int. Cl.[2] ..... A45C 11/38

[52] U.S. Cl. ..... 224/5 V; 150/52 J; 354/288

[58] Field of Search ..... 224/5 V, 5 R, 5 H, 26 R, 224/26 B, 25 R, 2 B; 354/288, 75, 86, 295, 289; 150/52 J; D87/5 E; 221/197, 185, 287

[56] References Cited

U.S. PATENT DOCUMENTS

| | | | |
|---|---|---|---|
| 1,513,176 | 10/1924 | Lyde | 150/52 J UX |
| 1,918,813 | 7/1933 | Kinzy | 354/82 X |
| 2,835,176 | 5/1958 | Land | 224/5 V X |
| 3,441,072 | 4/1969 | Schmitt | 354/288 X |
| 3,693,521 | 9/1972 | Harvey et al. | 354/86 |

FOREIGN PATENT DOCUMENTS

| | | | |
|---|---|---|---|
| 6411282 | 3/1966 | Netherlands | 150/52 J |

*Primary Examiner*—Trygve M. Blix
*Assistant Examiner*—Jerold M. Forsberg
*Attorney, Agent, or Firm*—Holman & Stern

[57] ABSTRACT

A camera case for use with cameras of the instant type is disclosed. The camera case of the present invention includes the feature that each of the various surfaces of the camera is fully protected by the case, while allowing easy access to each of the operating components of the camera. The camera case may be formed as a single-piece, unitary construction of a flexible material such as leather or plastic.

2 Claims, 6 Drawing Figures

CAMERA CASE

BACKGROUND AND SUMMARY OF THE INVENTION

The present invention is related to a case or cover for a camera. More particularly, the present invention is concerned with a case or cover for a camera of the instant reproduction type, in which the photograph, which may be partially or fully developed, is emitted practically instantaneously from the body of the camera upon taking of the picture.

Recent cameras of the so-called instant picture-taking type have been quite popular, in that the person taking the picture is allowed to obtain a fully developed photograph within a matter of a few seconds after the taking of the picture. There has been a requirement for a case or cover which would be particularly adapted or suited for cameras of this type, and which would allow ease of operation in the carrying out of the various functions and steps which are required in the taking of the picture and in the removal of the photograph from the body of the camera after the picture has been taken.

By the present invention, there is provided a case or cover for a camera of the instant picture-taking type in which the photograph is emitted from the body of the camera shortly after the picture has been taken. The camera case of the present invention includes the feature that each of the various surfaces of the camera is fully protected by the case, and the camera case also provides ready access to each of the various slots, buttons and other components of the camera which are required to be operated in order to take the picture. In addition, the camera case of the present invention may be constructed in a single one-piece construction of a flexible material such as leather, plastic or other similar material.

BRIEF DESCRIPTION OF THE DRAWINGS

The advantages and features of the camera case of the present invention will be more fully understood from the following description of the preferred embodiments, taken in conjunction with the accompanying drawings, wherein.

DESCRIPTION OF THE PREFERRED EMBODIMENTS

Figure 1:
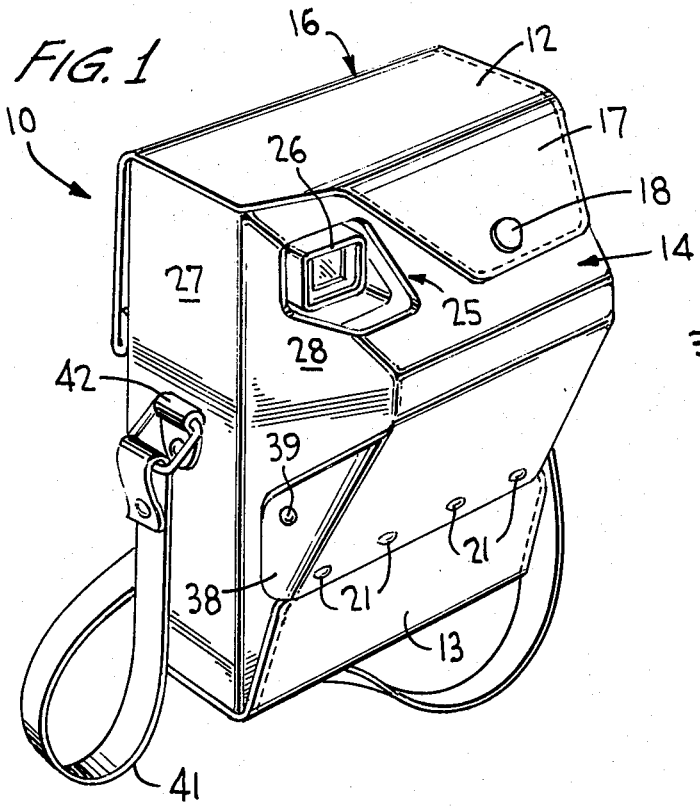
FIG. 1 is a perspective view from the rear of the camera case of the present invention, with a camera retained therein.
Figure 2:
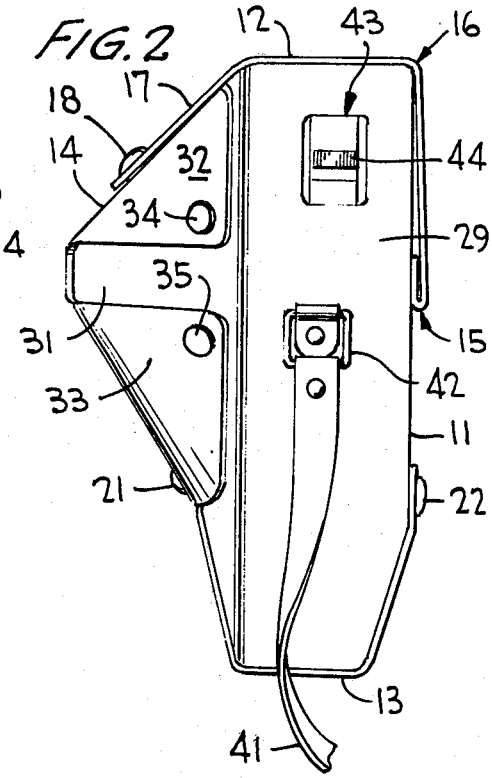
FIG. 2 is a right side elevation of the camera case of FIG. 1.
Figure 3:
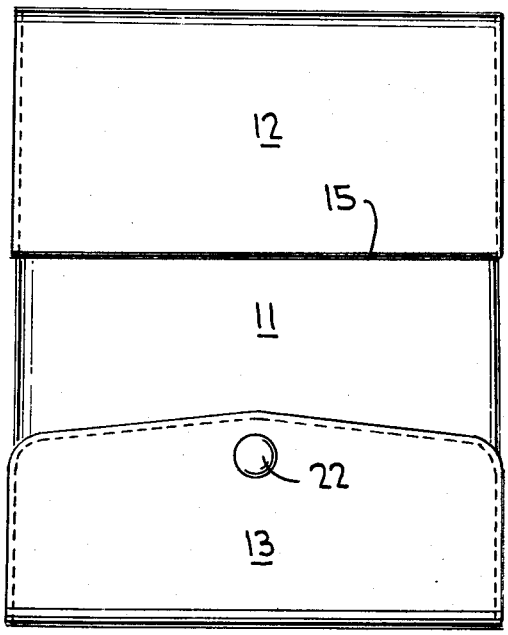
FIG. 3 is a front elevation of the camera case of FIG. 1.
Figure 4:
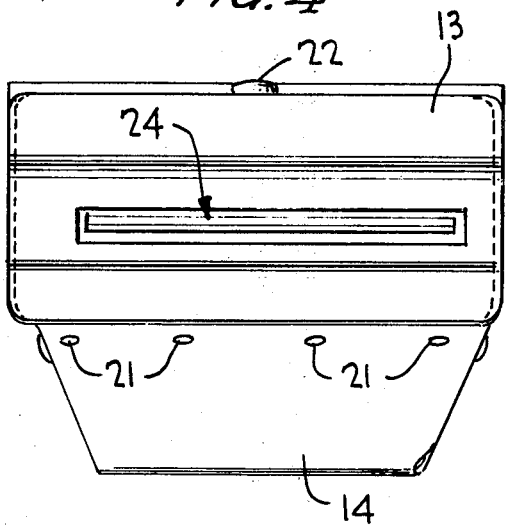
FIG. 4 is a bottom view of the camera case of FIG. 1.
Figure 5:
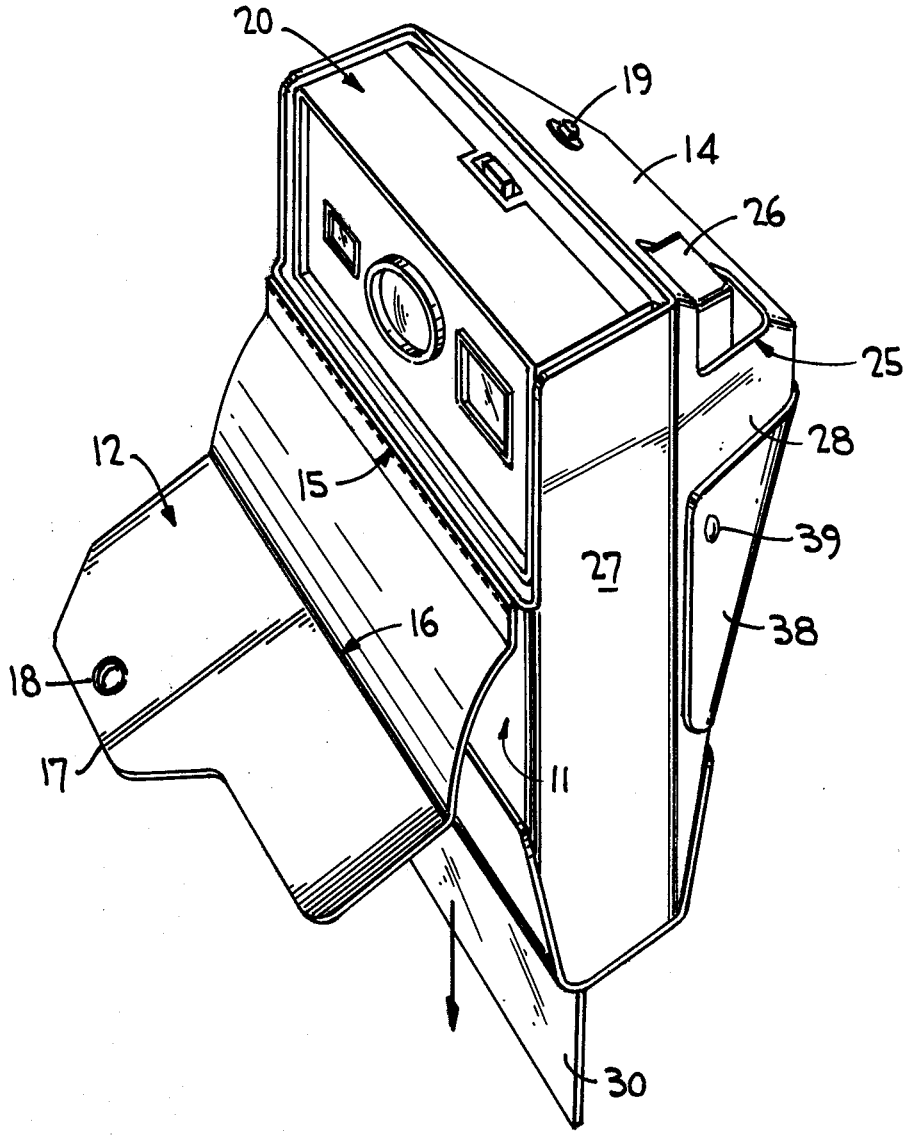
FIG. 5 is a perspective view from the front of the camera case of FIG. 1 with the front panel of the case having been unsnapped from the back and lowered to reveal the upper portion of the camera which is carried by the case.

In the illustrated embodiment of the present invention as shown in FIGS. 1 through 6, there is provided a camera case 10 formed of a unitary or single piece of flexible material. The particular case 10 shown in the drawings is for a Kodak Model EK 6 camera, but any other camera of this general type which produces finished photographs within a matter of seconds may be employed, and the case 10 is then constructed in a size to fit the particular camera. The case 10 includes a front panel 11, a top panel 12, a bottom panel 13 and a back panel 14. The top panel 12 is attached to the front panel 11 by means of a horizontal seam 15 which extends across the width of the case 10 just below the operating components of the camera 20 which are located on the upper portion of the camera 20, as shown in FIG. 5. The top panel 12 is provided with a crease 16 which allows the panel 12 to be folded in a snug fit over the camera 20 at the juncture of the front and top surfaces of the camera 20, as shown in FIG. 2. A flap 17 is provided on the rear portion of the top panel 12 and this flap 17 is equipped with releasable fastening means 18 such as a snap which mates with a corresponding fastening means 19 on the back panel 14 to secure the top panel 12 thereto.

The bottom panel 13 is secured to the back panel 14 by small brads 21 or other suitable securing means, as shown in FIG. 1. The bottom panel 13 extends from the back panel 14 down and around the underneath side of the camera 20 and is secured to the front panel 11 by releasable fastening means 22 such as a snap which mates with a corresponding fastening means 23 on the front panel 11, as shown in FIGS. 2 and 3. A slot 24 is provided substantially across the width of the bottom panel 13 approximately midway of the length thereof for the purpose of allowing the passage therethrough of photographs 30 as they are released from the lower end of the camera 20 upon the taking of a picture. The slot 24 should be of a size sufficient to allow the photograph to pass unhindered from the lower end of the camera 20 and outwardly therefrom for removal by the person operating the camera, as shown in FIGS. 4 and 5.

An opening 25 is provided in the back panel 14 in order to allow the reception of the camera eye piece 26 through which focusing is accomplished prior to the taking of the picture.

Connecting the back panel 14 and front panel 11 on the left side of the camera 20 are a left side panel 27 and triangular-shaped connecting panel 28, the latter being located between the side panel 27 and back panel 14, as shown in FIG. 1. The particular shape and location of the connecting panel 28 is required in order to conform to the converging nature of the back portion of the particular camera 20 shown in the drawings. A portion of the opening 25 for the eye piece 26 extends into the top of the connecting panel 28.

Figure 6:
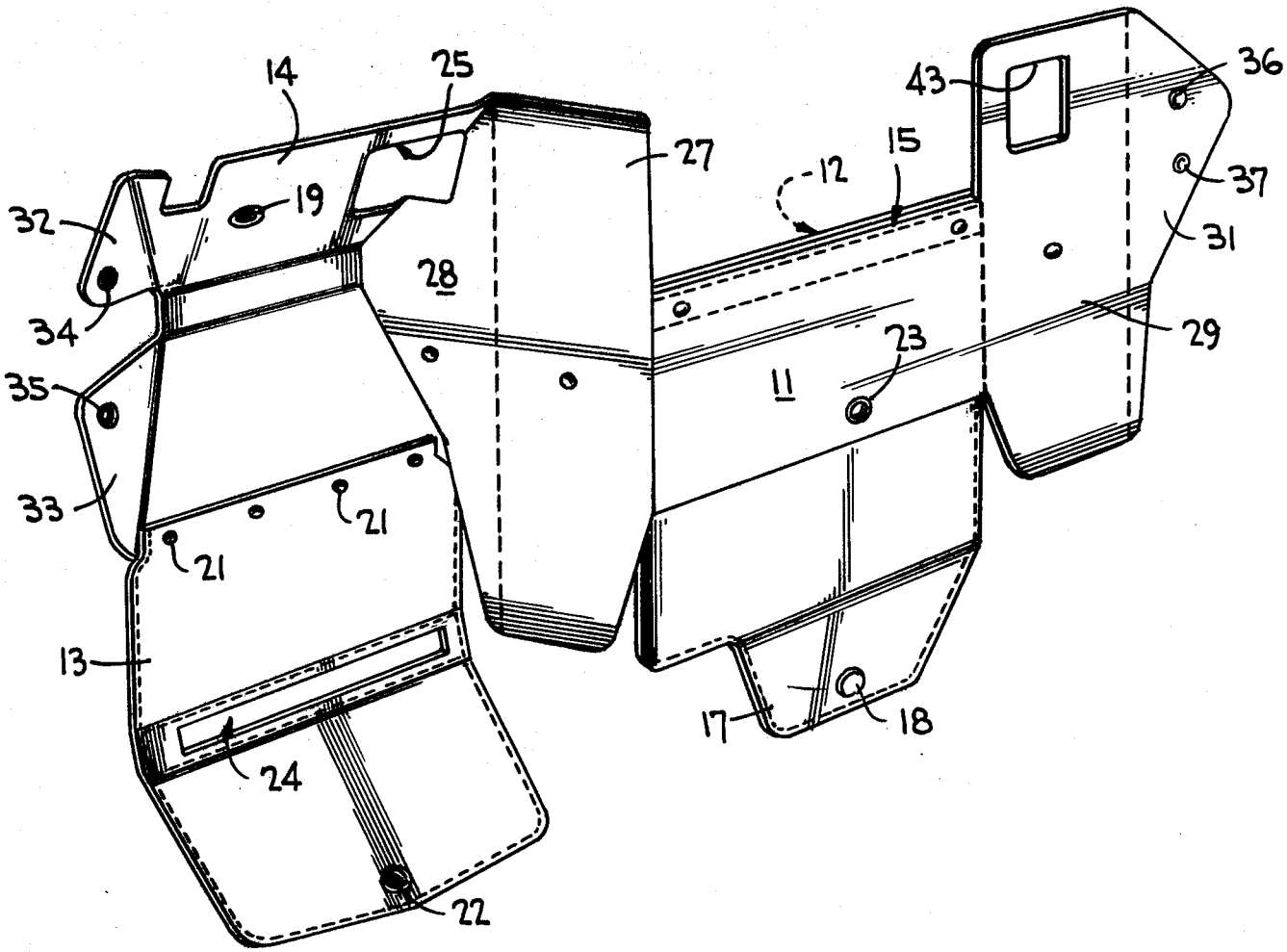
FIG. 6 is a perspective view of a unitary piece of flexible material from which the camera case of FIG. 1 is formed.

The right side panel 29 of the present camera case 10 is contiguous with the front panel 11, on the opposite side thereof from left side panel 27, as shown in FIGS. 2 and 6. As an extension of the right side panel 29, there is provided a triangular-shaped flap 31 which engages flaps 32 and 33 located on the upper and lower edge, respectively, of the right side of the back panel 14, as shown in FIGS. 2 and 6. Flaps 32 and 33 are secured to flap 31 by suitable releasable fastening means 34 and 35, such as snaps, on flaps 32 and 33 which mate with corresponding fastening means 36, 37 on the flap 31. Along the lower edge of the left side of the back panel 14 there is provided a flap 38 which is secured to connecting panel 28 by a brad 39 or other suitable securing means, as shown in FIG. 5.

A strap 41 is attached to the side panels 27, 29 by conventional fittings 42. The right side panel 29 is also provided with an opening 43 therein to provide access to the camera operating button 44 which is pressed to initiate the picture taking sequence.

The relationship of the various panels and flaps to each other in the unitary construction employed in the present camera case 10 is shown in FIG. 6.

It is thought that the invention and many of its attendant advantages will be understood from the foregoing description, and it will be apparent that various changes may be made in the form, construction and arrangement of the parts without departing from the spirit and scope of the invention or sacrificing its material advantages, the forms hereinbefore described being merely the preferred embodiments thereof.

The embodiments of the invention in which an exclusive property or privilege is claimed are defined as follows:

1. A camera case formed of a flexible material, for use with a camera of the instant type, whereby a photograph is released from the body of the camera within seconds after the taking of a picture, comprising: a unitary sheet folded to define a front panel, a back panel and a pair of side panels, said front, back and side panels being folded and secured to form a receptacle corresponding in size to a camera for receiving the same, a top panel attached to the front panel across the width of the case about midway of the height of the case, said top panel having a flap which is provided with means for releasably fastening said flap to the back panel, a bottom panel secured at one end to the back panel and having means on the opposite end for releasably fastening said bottom panel to the front panel, said bottom panel having a slot extending substantially across the width thereof approximately midway of the length of said bottom panel, said slot allowing the passage therethrough of photographs which are released from the lower end of the camera upon the taking of a picture, said back panel being provided with an opening therein to receive the camera eyepiece, said back panel and front panel being connected on one side through a first one of said side panels, and the second side panel extending from the side of said front panel opposite the first side panel, said second side panel having a flap on the side thereof opposite to said front panel, at least one flap attached to said back panel on the side thereof opposite to the side which is connected to said first side panel, and means for releasably fastening said flap of the second side panel to the flap of the back panel.

2. The camera case of claim 1, wherein an opening is provided in at least one of said first and second side panels to allow access to a camera operating button which is pressed to initiate the picture taking sequence.

* * * * *